US011774058B2

(12) United States Patent
Reisinger et al.

(10) Patent No.: US 11,774,058 B2
(45) Date of Patent: Oct. 3, 2023

(54) VEHICLE ILLUMINATION APPARATUS HAVING TWO DEFLECTORS AND AN EXPANDING OPTIC

(71) Applicant: ZKW Group GmbH, Wieselburg (AT)

(72) Inventors: Bettina Reisinger, Amstetten (AT); Markus Danner, Ollersdorf (AT); Josef Plank, Purgstall/Erlauf (AT); Christian Knobloch, Leiben (AT); Jakob Pühringer, Ybbs (AT); Josef Pürstinger, Bad Hall (AT)

(73) Assignee: ZKW Group GmbH, Wieselburg (AT)

( * ) Notice: Subject to any disclaimer, the term of this patent is extended or adjusted under 35 U.S.C. 154(b) by 0 days.

(21) Appl. No.: 17/771,713

(22) PCT Filed: Oct. 22, 2020

(86) PCT No.: PCT/EP2020/079705

§ 371 (c)(1),
(2) Date: Apr. 25, 2022

(87) PCT Pub. No.: WO2021/089332

PCT Pub. Date: May 14, 2021

(65) Prior Publication Data

US 2022/0373150 A1 Nov. 24, 2022

(30) Foreign Application Priority Data

Nov. 8, 2019 (EP) ..... 19208028

(51) Int. Cl.
*F21S 41/20* (2018.01)
*F21S 41/365* (2018.01)
*F21S 41/64* (2018.01)

(52) U.S. Cl.
CPC ..... *F21S 41/285* (2018.01); *F21S 41/365* (2018.01); *F21S 41/645* (2018.01)

(58) Field of Classification Search
CPC ..... F21S 41/645; F21S 41/365; F21V 7/0033
See application file for complete search history.

(56) References Cited

U.S. PATENT DOCUMENTS 9,879,839 B2 * 1/2018 Yang ..... F21S 41/20
2014/0071704 A1 * 3/2014 Yagi ..... F21S 41/365 362/516

(Continued)

FOREIGN PATENT DOCUMENTS

DE 102014013202 B3 2/2016
DE 102015221049 A1 5/2017

(Continued)

OTHER PUBLICATIONS

International Search Report for PCT/EP2020/079705, dated Mar. 5, 2021 (13 pages).

(Continued)

*Primary Examiner* — Robert J May
(74) *Attorney, Agent, or Firm* — Eversheds Sutherland (US) LLP

(57) ABSTRACT

An illumination device (10) for a motor vehicle headlight, wherein the illumination device (10) comprises:

a light source (50) for irradiating a light beam in a first direction of radiation (X1), a first deflection device (100) configured to deflect the light beam in a second direction of radiation (X2), and a second deflection device (200) for deflecting the light beam deflected by the first deflection device (100) in a third direction of radiation (X3) and for producing a light distribution in front of the illumination device (10), wherein the illumination device comprises at least one expanding optic (300) with a focus (F1), wherein said expanding optic (300) is associated with the at least one light source (50) and is configured to expand the light beam emitted by the light (Continued)

source (50) in the direction of the first direction of radiation (X1), wherein the at least one light source (50) is arranged in the direction of the first direction of radiation (X1) between the at least one expanding optic (300) and the focus (F1) of the expanding optic (300).

10 Claims, 1 Drawing Sheet

(56) References Cited

U.S. PATENT DOCUMENTS

| | | | |
|---|---|---|---|
| 2018/0031202 | A1 | 2/2018 | Bhakta |
| 2018/0224082 | A1 | 8/2018 | Reinprecht et al. |
| 2019/0116345 | A1 | 4/2019 | Albou et al. |
| 2019/0195459 | A1 | 6/2019 | Reisinger et al. |

FOREIGN PATENT DOCUMENTS

| | | | |
|---|---|---|---|
| DE | 102017207350 | A1 | 8/2018 |
| DE | 102018204282 | A1 | 9/2019 |
| DE | 102018107678 | A1 | 10/2019 |

OTHER PUBLICATIONS

Search Report for European Patent Application No. 19208028.1 dated May 4, 2020 (8 pages).

* cited by examiner

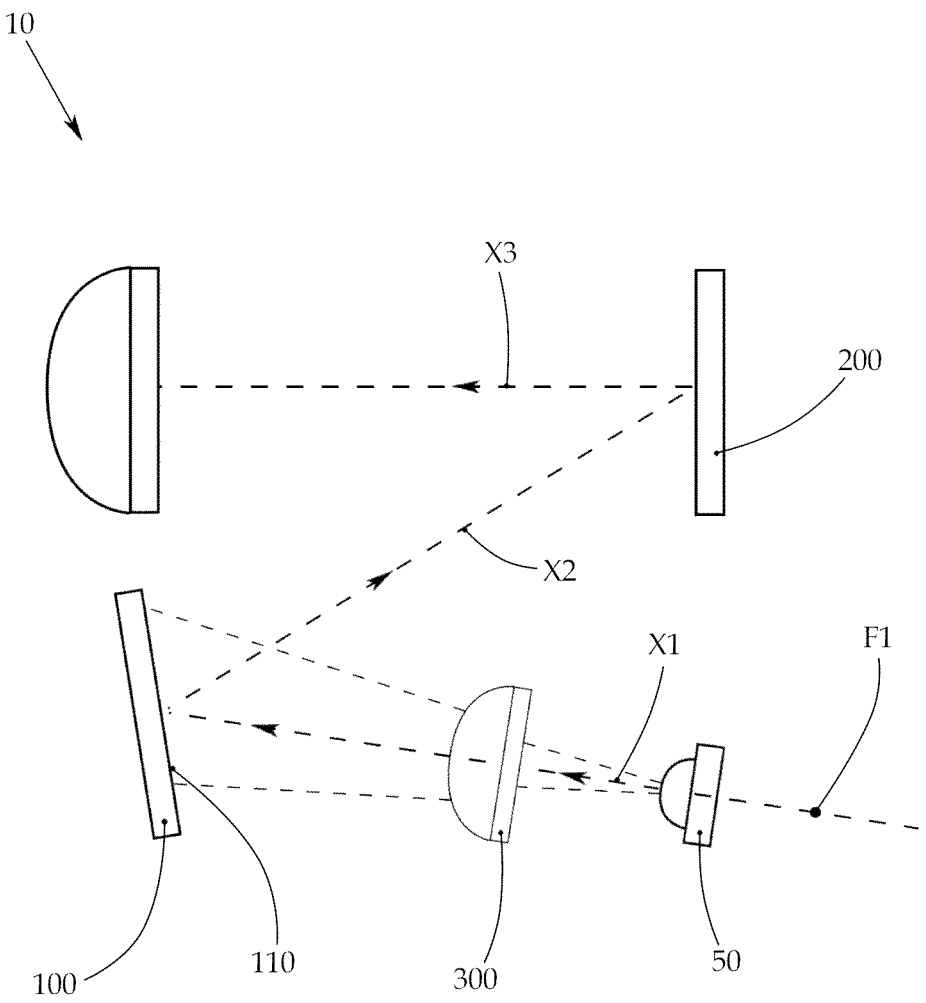
10
X3
200
X2
X1
F1
100
110
300
50

VEHICLE ILLUMINATION APPARATUS HAVING TWO DEFLECTORS AND AN EXPANDING OPTIC

The invention relates to an illumination device for a motor vehicle headlight, wherein the illumination device comprises the following:

- at least one light source for radiating a light beam in a first direction of radiation,
- a first deflection device with a deflection surface configured to deflect at least part of the light beam of the at least one light source in a second direction of radiation, and
- a second deflection device with a plurality of independently controllable and movable deflection elements for deflecting at least part of the light beam deflected by the first deflection device into a third direction of radiation and for producing a light distribution in front of the illumination device.

The invention further relates to a motor vehicle headlight comprising at least one illumination device according to the invention.

In the development of current headlight systems, there is a growing focus on the desire to be able to project a light image with a resolution that is as high as possible onto the road, which light image can be changed quickly and adapted to actual traffic, road and lighting conditions, wherein an assembly design or assembly size that is as compact as possible is also desirable.

The term "road" is used here for the purposes of simplified illustration, as it obviously depends on local circumstances whether a light image is in fact located on the road or extends beyond it, for example onto the edge of the road.

In principle, the light image is described based on a projection onto a vertical surface in accordance with the relevant standards relating to motor vehicle illumination technology, a variably controllable reflector surface being formed from a plurality of micromirrors and reflecting light rays emitted by a first light-emitting means in a direction of radiation of the headlight.

Any desired lighting functions with different light distributions can be realized such as, for example, a low-beam light distribution, a cornering-lighting light distribution, a city-lighting light distribution, a motorway-lighting light distribution, a curve-lighting light distribution, a high-beam light distribution or the constitution of a glare-free high beam. In addition, there can also occur symbol projections such as, for example, hazard symbols, navigation arrows, manufacturer logos or the like.

For the micromirror arrangement, it is preferable to use so-called digital light processing projection technology—DLP for short—in which images are created by modulating a digital image onto a light beam. By means of a rectangular arrangement of movable micromirrors, also designated as pixels, the light beam is split into subsections and subsequently reflected or deflected pixelwise either into the projection path or out of the projection path.

This technology is preferably based on an optoelectronic component that contains the rectangular arrangement in the form of a matrix of micromirrors and the technology for their control, for example a digital micromirror device—called DMD for short.

A DMD microsystem is a spatial light modulator (SLM) consisting of micromirror actuators arranged in the shape of a matrix, i.e. tiltable or pivotable reflecting surfaces, for example with an edge length of approximately 7 μm. The mirror surfaces are designed so as to be movable through the action of electrostatic fields.

Each micromirror is individually adjustable in its angle and generally has two stable end states between which, for example, it can be toggled as many as 5000 times in a second.

The number of micromirrors corresponds to the resolution of the projected image, wherein a micromirror can represent one or more pixels. DMD chips with high resolutions in the megapixel range are now available.

In currently employed motor vehicle headlights, the light distribution produced, for example for a glare-free high beam, can be controlled dynamically such that oncoming vehicles are detected and the light distribution produced, for example, by a matrix of LED light sources is dimmed in the direction of the oncoming vehicle.

With DMD illumination, flat surfaces must always be entirely illuminated, although, unlike cinematic or business-meeting projectors with which the aim is to achieve a uniform or homogeneous illumination of the entire DMD surface, in applications in the automotive sector one strives to adapt the illumination of the typical light distributions, for example of a high beam. As a rule, this means a maximum brightness in the centre of the DMD or illuminated DMD area with a drop in illumination intensity towards the edges.

In general, in the sector of high-resolution lighting systems, in particular in the sector of DMD technology, there is the issue that a fully functional lighting function is not to be expected as a result of limitations due to the light source that can be used to illuminate the DMD. In particular, a fully functional high beam with a high maximum (greater than 100 lx) and a width of +/−20° (measured according to an ECE measuring screen) is not attainable. The high-beam distribution producible by a DMD or DLP module is relatively narrow with maximum expected widths of +/−10°.

It is thus necessary to add further auxiliary modules which produce the full width of the high beam or high-beam distribution, wherein these auxiliary modules typically have to be placed somewhere in the headlight and are undesirable in terms of design and the assembly space they take up in the motor vehicle headlight.

It is an object of the invention to provide an improved illumination device.

This object is achieved by an illumination device comprising at least one expanding optic with a focus, wherein the expanding optic is associated with the at least one light source and is configured to expand the light beam emitted by the light source in the direction of the first direction of radiation, wherein the at least one light source is arranged in the direction of the first direction of radiation between the at least one expanding optic and the focus of the expanding optic.

The term "expansion" or "expand" is understood to mean a magnification of an optical beam diameter to a certain size. An expansion can be brought about by means of different optical lens systems. This is, however, known to a person skilled in the art and is only reiterated here for the sake of completeness.

By arranging the at least one light source between the expanding optic and the focus of the expanding optic, the light source or light-emitting surface of the light source is imaged virtually behind the light source contrary to the first direction of radiation or main direction of radiation of the light source. By means of the virtual imaging of the light source, the irradiated light beam is magnified at the first deflection device. This has the effect that a larger area of the first deflection device can be irradiated while the length of the optical path between the light source and the first deflection device is simultaneously minimized, i.e. the overall assembly space of the illumination device can be reduced.

"Main direction of radiation" is understood as the direction in which the at least one light source irradiates light with the greatest intensity or the most light as a result of its directionality.

It can be provided that the second deflection device is configured as a digital micromirror array with a plurality of micromirrors arrayed next to one another and controllable individually or in groups.

Advantageously, the second deflection element can be configured as a DMD.

If cases where a DMD is used, it is important to work with very small light entry angle ranges, i.e. if light rays hit the micromirrors of the DMD at an angle that is too steep or too flat, a backlighting of the micromirrors can occur, which in turn leads to scattered light in the projected light image and thus to a poor light-dark contrast, which is extremely important in motor vehicle headlight applications.

Each micromirror is individually adjustable in its angle and generally has two stable end states between which it can be tilted.

By means of a targeted movement of individual deflection elements or a group of selected deflection elements, the form of the irradiated light distribution of the illumination device as well as the light intensity distribution within the irradiated light distribution can be varied. The irradiated light distribution is thus dynamically modifiable both in terms of its form (expansion and/or extension) and in terms of its brightness distribution. The control of the deflection elements, and thus the variation of the irradiated light distribution, can occur as a function of the operating parameters of the motor vehicle (e.g. vehicle speed, load, steering angle, lateral acceleration, etc.). Environmental parameters of the vehicle (e.g. external temperature, precipitation, detected other road users in the area surrounding the vehicle, etc.) can also be taken into account in the control of the deflection elements.

It can be provided that the at least one light source is configured as at least one light-emitting diode or as at least one laser diode.

It can be provided that the illumination device comprises at least two light sources, preferably exactly two light sources.

In cases where two light sources, each with a respective expanding optic, are used, the respectively expanded light beams can be arranged so as to partially overlap. The desired overlap can be set via the magnification of the light beams, whereby the centre of the second deflection element can be irradiated with a higher brightness.

It can be provided that the illumination device comprises at least two expanding optics, preferably exactly two expanding optics, wherein exactly one expanding optic is associated with each light source.

It can be provided that the first direction of radiation is parallel to the third direction of radiation.

It can be provided that the deflection surface of the first deflection device is configured as a hyperbolic, parabolic or ellipsoidal reflector.

It can be provided that the first deflection device focuses the light beam of the at least one light source onto a point located behind the second deflection device in the direction of the second direction of radiation.

The object is also achieved by a motor vehicle headlight with at least one illumination device according to the invention.

The invention is explained in more detail in the following with reference to illustrative drawings, which show FIG. 1 a schematic illustration of an example illumination device.

FIG. 1 shows an illustrative illumination device 10 for a motor vehicle headlight, wherein the illumination device 10 comprises a light source 50 for irradiating a light beam in a first direction of radiation X1, the light source 50 being configured as a light-emitting diode or LED, and a first deflection device 100 with a deflection surface 110 configured to deflect at least part of the light beam of the light source 50 in a second direction of radiation X2.

The illumination device 10 further comprises a second deflection device 200 with a plurality of independently controllable and movable deflection elements for deflecting at least part of the light beam deflected by the first deflection device 100 in a third direction of radiation X3 and for producing a light distribution in front of the illumination device 10.

In the illustrated example, the second deflection device 200 is configured as a digital micromirror array (also called DMD) with a plurality of micromirrors arrayed next to one another and controllable individually or in groups.

The illumination device 10 further comprises an expanding optic 300 with a focus F1, wherein said expanding optic 300 is associated with the light source 50 and is configured to expand the light beam emitted by the light source 50 in the direction of the first direction of radiation X1, wherein the light source 50 is arranged in the direction of the first direction of radiation X1 between the expanding optic 300 and the focus F1 of the expanding optic 300.

The term "expansion" or "expand" is understood to mean a magnification of an optical beam diameter to a certain size. An expansion can be brought about, for example, by means of different optical lens systems. The illustrated example, however, shows a single expanding optic 300 or lens and not an optical system consisting of a plurality of lenses.

In other words, the light beam irradiated by the light source 50 and impinging on the expanding optic 300 exhibits a certain beam diameter on the light entry side of the expanding optic 300 and a larger beam diameter after it leaves the light exit side of the expanding optic 300 due to the expanding optic 300.

By arranging the light source 50 between the expanding optic 300 and the focus F1 of the expanding optic 300, the light source 50 or light-emitting surface of the light source 50 is imaged virtually behind the light source 50 contrary to the first direction of radiation X1 or main direction of radiation of the light source 50. By means of the virtual imaging of the light source 50, the irradiated light beam is magnified at the first deflection device 100. This has the effect that a larger area of the first deflection device 100 can be irradiated while the length of the optical path between the light source 50 and the first deflection element 100 is simultaneously minimized, i.e. the overall assembly space of the illumination device 100 can be reduced.

"Main direction of radiation" is to be understood as the direction in which a light source 50 irradiates light with the greatest intensity or the most light as a result of its directionality.

It can be provided that the deflection surface 110 of the first deflection device 100 is configured as a hyperbolic, parabolic or ellipsoidal reflector. The first deflection element 100 can further focus the light beam of the light source 50 onto a point located behind the second deflection device 200 in the direction of the second direction of radiation X2.

As a further embodiment of the illustrative illumination device in FIG. 1, it is possible to provide exactly two light sources, wherein exactly one expanding optic is associated with each light source.

| LIST OF REFERENCE SIGNS | |
|---|---|
| Illumination device . . . | 10 |
| Light source . . . | 50 |
| First deflection device . . . | 100 |
| Deflection surface . . . | 110 |
| Second deflection device . . . | 200 |
| Expanding optic . . . | 300 |
| Focus . . . | F1 |
| First direction of radiation . . . | X1 |
| Second direction of radiation . . . | X2 |
| Third direction of radiation . . . | X3 |

The invention claimed is:

1. An illumination device (10) for a motor vehicle headlight, wherein the illumination device comprises the following:

at least one light source (50) for irradiating a light beam in a first direction of radiation (X1);

a first deflection device (100) with a deflection surface (110) configured to deflect at least part of the light beam of the at least one light source (50) in a second direction of radiation (X2); and a second deflection device (200) with a plurality of independently controllable and movable deflection elements for deflecting at least part of the light beam deflected by the first deflection device (100) in a third direction of radiation (X3) and for producing a light distribution in front of the illumination device (10), wherein the illumination device comprises at least one expanding optic (300) with a focus (F1), wherein said expanding optic (300) is associated with the at least one light source (50) and is configured to expand the light beam emitted by the light source (50) in the direction of the first direction of radiation (X1), wherein the at least one light source (50) is arranged in the direction of the first direction of radiation (X1) between the at least one expanding optic (300) and the focus (F1) of the expanding optic (300), wherein the first deflection device (100) is configured to focus the light beam of the at least one light source (50) onto a point located behind the second deflection device (200) in the direction of the second direction of radiation (X2).

2. The illumination device according to claim 1, wherein the second deflection device (200) is configured as a digital micromirror array with a plurality of micromirrors arrayed next to one another and controllable individually or in groups.

3. The illumination device according to claim 1, wherein the at least one light source (50) is configured as at least one light-emitting diode or as at least one laser diode.

4. The illumination device according to claim 1, wherein the illumination device (10) comprises at least two light sources (50).

5. The illumination device according to claim 4, wherein the illumination device comprises at least two expanding optics (300), wherein exactly one expanding optic (300) is associated with each light source.

6. The illumination device according to claim 5, wherein the illumination device comprises exactly two expanding optics (300).

7. The illumination device according to claim 4, wherein the illumination device (10) comprises exactly two light sources (50).

8. The illumination device according to claim 1, wherein the first direction of radiation (X1) is parallel to the third direction of radiation (X3).

9. The illumination device according to claim 1, wherein the deflection surface (110) of the first deflection device (100) is configured as a hyperbolic, parabolic or ellipsoidal reflector.

10. A motor vehicle headlight comprising at least one illumination device according to claim 1.

* * * * *